United States Patent [19]

Brandemuehl et al.

[11] Patent Number: 4,875,341

[45] Date of Patent: Oct. 24, 1989

[54] CONTROL APPARATUS FOR REFRIGERATED CARGO CONTAINER

[75] Inventors: Michael J. Brandemuehl, Manlius; John R. Reason, Liverpool, both of N.Y.

[73] Assignee: Carrier Corporation, Syracuse, N.Y.

[21] Appl. No.: 278,683

[22] Filed: Dec. 1, 1988

Related U.S. Application Data

[62] Division of Ser. No. 125,213, Nov. 25, 1987, Pat. No. 4,789,025.

[51] Int. Cl.[4] ..... F25B 41/04

[52] U.S. Cl. ..... 62/115; 62/217; 236/78 C

[58] Field of Search ..... 236/78 D, 78 C; 62/217; 364/162; 318/596, 610

[56] References Cited

U.S. PATENT DOCUMENTS 4,547,977 10/1985 Tenedini et al. ..... 236/78 D X 4,787,554 11/1988 Bartels et al. ..... 236/78 D X

FOREIGN PATENT DOCUMENTS 0239310 10/1986 Japan ..... 236/78 D

*Primary Examiner*—William E. Wayne

*Attorney, Agent, or Firm*—Robert H. Kelly

[57] ABSTRACT

A method of closely controlling the supply air temperature delivered from an air conditioning unit into a mobile cargo container wherein the supply air temperature is compared to a desired set point temperature and a suction control valve in the air conditioner compressor inlet line is adjusted in response to the sensed difference between the supply air temperature and the set point temperature. Three different preprogramed control modes are available which are selected automatically in response to the amount of deviation between the compared temperatures that are used to bring the supply temperature down the set point temperature and hold it under steady state conditions within ±0.25° C. of the set point. A trim heater is placed in the supply air passage to warm the supply air any time the control valve is in a full closed position. This increases the heating load on the unit so that operating time of the unit will be prolonged and the compressor will not be cycling ON and OFF.

3 Claims, 1 Drawing Sheet

CONTROL APPARATUS FOR REFRIGERATED CARGO CONTAINER

This application is a division, of application Ser. No. 125,213, filed Nov. 25, 1987, now U.S. Pat. No. 4,789,025.

BACKGROUND OF THE INVENTION

This invention relates to controlling a refrigeration unit used to chill the interior of a mobile cargo container and, in particular, a method for holding the supply air temperature delivered to a cargo container within extremely close limits.

Many control systems found on later model air conditioning units used to cool the interior of refrigerated cargo containers include a processor that is programmed to adjust a control valve mounted in the compressor suction line of the air conditioning unit. The valve is adjustable between a fully open and fully closed position. The processor receives supply air temperature information and adjusts the valve setting based upon a preprogrammed schedule in response to the deviation of the sensed supply air temperature from a predetermined set point temperature.

The program used to control the position of the suction valve typically has three terms that are summed to arrive at a desired valve setting. The terms are all based upon the amount of deviation between the sensed supply air temperature and the desired set point temperature. The program not only looks at present conditions, but also at the history leading up to the present condition. The first term in the formulation is a proportional term relating to the present deviation (P), the second term involves an integral term based upon accumulated supply air temperature data (I), and the last term is a derivative term based on changes in supply air deviations (D). This formulation has come to be known in the industry as a PID control program because of the nature of the three terms involved.

Each of the three terms in the PID control formulation is multiplied by a control constant. The constants are selected to maintain the supply air temperature as close as reasonably practical to the set point temperature when the refrigeration unit is operating under steady state conditions. When the supply air temperature deviates some small amount from the set point temperature, the processor adjusts the suction control valve setting to bring the temperature back towards the desired set point. However, when the deviation between the supply air temperature and the set point temperature is relatively large, as for example when a cargo container door is left open, or during start up, the time for the system to near the set point temperature may be relatively long and the cargo stored in the container may be endangered.

By the same token, the PID program is unable to maintain continuous control over the system when the cooling load is small, as for example, when the ambient temperature is very low. When the unit is operating at or close to minimum capacity the suction valve is typically fully closed and no further control can be exercised over the system. By the time control is regained the supply air temperature can deviate from the set point temperature to a point where a temperature sensitive cargo may be endangered. By the time the system has a chance to recover, the cargo may be damaged.

The PID constants used in a typical program are selected to provide for a reasonable recovery time while still being able to maintain the supply air temperature close to a desired set point temperature. It is, however, highly desirous when transporting certain temperature sensitive produce to maintain the container temperature within extremely close tolerances, that is, within 0.25 degrees C. of the desired set point temperature. Present day PID control systems cannot deliver this type of close control.

SUMMARY OF THE INVENTION

It is therefore an object of the present invention to improve refrigerated cargo containers.

It is a further object of the present invention to provide an improved means for controlling the temperature of chilled air delivered to a refrigerated cargo container.

A still further object of the present invention is to maintain the supply air temperature delivered to a refrigerated cargo container within 0.25 degrees C of a desired set point.

Another object of the present invention is to exercise continuous control over an air conditioning unit used to provide supply air to a refrigerated cargo container.

Yet another object of the present invention is to provide a control system for a refrigerated cargo container that is capable of automatically holding the container close to a desired operating temperature and to recover rapidly in the event the container temperature deviates widely from the desired operating temperature.

These and other objects of the present invention are attained by method and apparatus for controlling the temperature of the supply air delivered from a refrigeration unit to a mobile cargo container in order to hold the supply air temperature to within 0.25 degrees C of a desired operating temperature. A processor is arranged to open and close a control valve located in the suction line of the refrigeration unit to regulate the capacity of the unit and thus the supply air temperature. A sensor in the supply air passage provides temperature data to a comparator that compares the sensed temperature to a desired set point temperature and, in turn, supplies the processor with a signal indicative of the amount of deviation between the supply air temperature and the set point temperature. The processor utilizes a PID program to adjust the position of the control valve. The constants relating to the three terms of the formulation, however, are changed in response to the amount of sensed deviation. When the supply air temperature exceeds the set point temperature by a first value, the processor automatically opens the control valve fully to bring the supply air temperature rapidly toward the set point temperature. However, when the deviation is below the first value but greater than a second lower value, the valve setting is adjusted to change the supply temperature at a lesser intermediate rate. This lesser intermediate rate is achieved by adjusting the control valve a first number of increments during each sensing interval when the amount of deviation is between the first value and the second lesser value. Upon the amount of deviation reaching a valve less than the second lower value, the control valve setting is again adjusted to reduce the supply air temperature at a comparatively slower rate which enables the processor to hold the supply air temperature to within 0.25 degrees C of the set point temperature. This comparatively slower rate is achieved by adjusting the control valve a second number of increments during each sensing interval when the amount of deviation is less than the second lower value.

A trim heater is placed in the supply air passage upstream from the sensor which is arranged to be turned on by the processor when the control valve reaches a fully closed position. The heater, in operation, does not permit the valve to remain fully closed so that the processor is able to maintain full control over the refrigeration unit at all times. By maintaining continuous control over the unit, the supply air temperature is never permitted to deviate very far from the set point temperature. As a result, the container can safely transport temperature sensitive produce over long periods of time without danger of the cargo being harmed.

BRIEF DESCRIPTION OF THE DRAWING

For a better understanding of these and other objects of the present invention, reference is made to the following detailed description of the invention that is to be read in conjunction with the accompanying drawing, wherein.

DETAILED DESCRIPTION OF THE INVENTION

Figure 1:
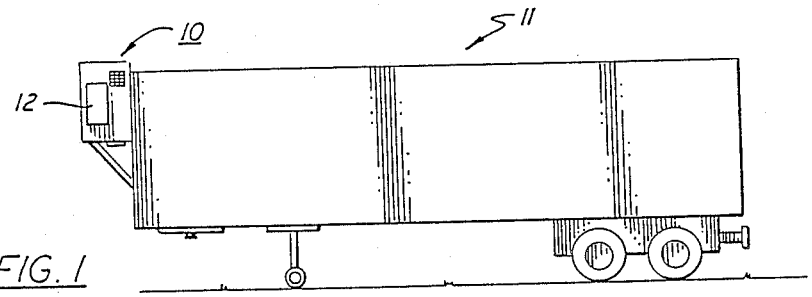
FIG. 1 is a side elevation of a refrigerated cargo container that includes a refrigeration unit embodying the teachings of the present invention.

As illustrated in FIG. 1, the present invention involves an air conditioning or refrigeration unit, generally referenced 10, that is employed to provide chilled air to a mobile cargo container 11. The refrigeration unit is generally supplied with electric power from a self contained diesel generator 12 so that conditioned supply air is continually delivered to the container regardless of its means used to transport the container. Accordingly, the container can be drawn by a tractor or loaded upon a railroad car or a ship without the danger of the cargo being applied. However, the refrigeration unit may be supplied with external electric power, e.g. ship power.

As previously noted, when this type of container is used to haul certain types of temperature sensitive products, such as lamb and bananas, it is highly desirous to hold the container temperature as close as possible to a predetermined set point temperature in order to maintain the cargo in a condition that will enhance its market value. Any very small deviation from the set point temperature will seriously degrade the value of the product and the one transporting the goods most often bears the risk. Transporters are now seeking refrigerated containers in which the box temperature can be held to about one quarter of a degree centigrade of a desired set point temperature over extended periods of time.

Existing PID control systems cannot hold the supply air temperature to this close tolerance. Furthermore, these systems depend on a single control formulation for changing the supply air temperature regardless of the spread between the supply air temperature and the set point temperatures. The rate of change is relatively slow so that the amount of time required to pump the system down at start up or to recover when the cargo door is opened is typically relatively long. In addition, these prior art systems lose control of refrigeration units any time the unit reaches its minimum operating capacity. Before control can be regained, the supply air temperature can drift a considerable distance from the set point temperature.

Figure 2:
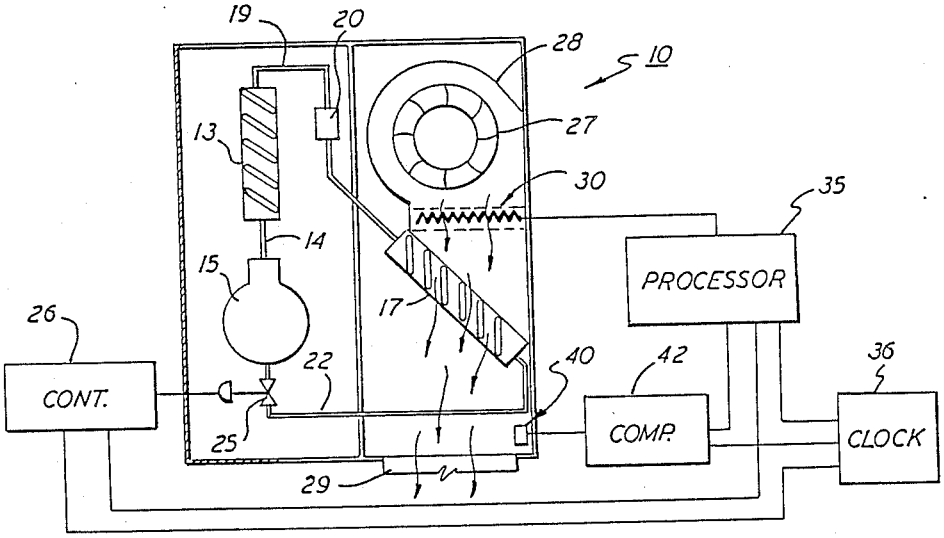
FIG. 2 is a schematic view of the air conditioning unit illustrated in FIG. 1.

Turning now to FIG. 2, there is illustrated a refrigeration unit 10 that includes a control system for regulating the temperature of the supply air provided to a mobile cargo container. The refrigeration unit includes a condenser 13 that is connected on one side to the discharge line 14 of a refrigerant compressor 15 and on the other side to an evaporator 17 by means of liquid line 19. An extension device 20 is contained in the liquid line which throttles refrigerant as it moves from the condenser to the evaporator. Refrigerant leaving the evaporator is returned to the compressor by means of a suction line 22.

An electrical control valve 25 is connected into the suction line of the refrigerating unit. The valve is used to adjust the capacity of the unit and thus control the temperature of the chilled supply air delivered to the container. When the valve is fully opened the unit is operating at a maximum capacity and when it is fully closed the unit is operating at minimum capacity. The control valve is positioned by an electronic controller 26 which is arranged to move the valve in uniform increments between the fully opened and closed positions. The valve is set so that each incremental change in its setting will produce relatively small change in the supply air temperature.

Air is drawn from inside the container by means of a fan means, e.g. an impellar 27 located inside a scroll 28 or a propeller fan. The air is chilled as it is pumped by the fan over the evaporator heat exchanger surfaces and is returned to the container through a supply air duct 29. A trim heater 30, the function of which will be explained in greater detail below, is positioned in the supply air passage between the impellar and the evaporator.

The controller is connected to a processor 35 and to a system clock 36 by suitable electrical lines. A temperature sensor 40 is located at the entrance of the supply air duct 29 and is arranged to sense the temperature of the chilled air that is being returned to the cargo container. The sensor sends supply air temperature data to a comparator circuit 42 where it is compared to a desired set point temperature. A signal indicative of the deviation between the supply air temperature and the set point temperature is then forwarded to the processor. A positive going signal indicates that the supply air temperature is higher than the set point temperature while a negative going signal indicates the supply air temperature is lower than the set point temperature. The comparator responds to the system clock to send the deviation signals to the processor at predetermined intervals.

The processor utilizes a basic PID algorithm to control the position of the control valve in response to the amount of deviation detected between the supply air and set point temperatures. The algorithm utilizes a PID formulation in the form:

$$\text{Valve Position} = C_P(P) + C_I(I) + C_D(D)$$

where:

P is the deviation between supply air and set point temperatures,

I is accumulated supply air temperature deviation,

D is the change in supply air temperature deviation, $C_P$ is a proportional constant, $C_I$ is an integral constant, and $D_D$ is a derivative constant.

Three separate sets of constants are used in the processor to adjust the control valve setting. A first set of constants are selected to maintain extremely close control over the supply air temperature when this temperature is brought to within ±1.0° C. of the set point temperature. The constants are such that slight incremental adjustments are periodically made to the control valve so that the supply air temperature can be held to within about 0.25° C. of the set point temperature when the unit is operating within this range.

When the supply air temperature deviates between 1.0° C. and 2.5° C. from the set point temperature, the integral and derivative constants are programed to remain unchanged, however, the proportional constant ($C_P$) is programed to vary linearly with the amount of deviation to change the supply air temperature at a greater rate. When the deviation becomes greater than +2.5° C., the integral and derivative constant values are programmed to go to zero and the proportional constant is programmed to move the suction valve to a fully opened position. As can be seen, by programming PID constants to different values in response to the sensed temperature deviation, the rate of change of the supply air temperature is regulated to provide an improved system response over the entire range of temperatures.

Figure 3:
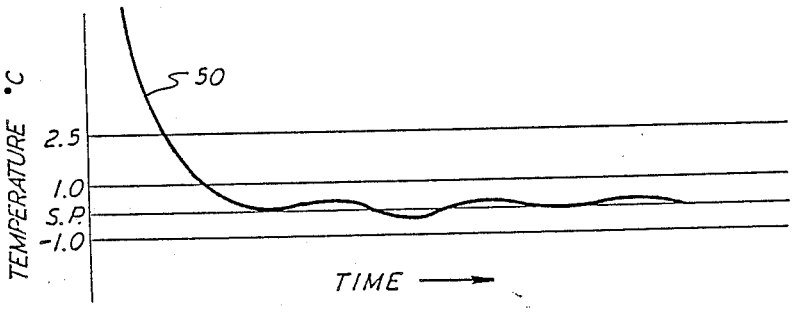
FIG. 3 is a graphic representation relating supply air temperature to time showing the rate of change in temperature as the refrigeration unit is being pumped down.

Turning now to FIG. 3, there is shown graphically a curve 50 representing the supply air temperature of the present system as it moves from an initial start up condition into a desired steady state operating condition at or close to the set point (S.P.) temperature. At start up when the temperature deviation between set point and ambient is greater than 2.5° C., the comparator circuit of the control system tells the processor of the condition and the processor instructs the controller to move the suction valve to a fully opened position. Accordingly, the refrigeration system is pumped down as rapidly as possible and the supply air temperature drops at a correspondingly rapid rate.

When the supply air temperature reaches a point about 2.5° C. above the set point temperature, the processor sets a set of constants into the PID equation which causes the valve controller to close the valve a certain number of increments during each temperature sensing interval whereby the supply air temperature changes at a slower intermediate rate. The supply air temperature continues to fall at an intermediate rate until the deviation between the set point temperature and the supply air temperature reaches about 1.0° C. The comparator circuit senses this condition and signals the processor to select a new set of PID constants that are selected to close the valve a second lesser number of increments during each subsequent temperature sensing interval. This, in turn, produces a second reduction in the rate of change in the supply air temperature thereby providing the control system with greater control sensitivity. The number of increments that the valve is turned during each sensing interval is reduced to a level such that the supply air temperature can be held to about 0.20° C. of the set point temperature. In the event the supply air temperature drops below the set point temperature, the comparator applies a negative going signal to the processor which in turn instructs the controller to open or close the suction valve utilizing the second lesser number of increments during the next sensing cycle.

There may be times, for example when the ambient temperature is relatively cold, when the cooling load on the refrigeration unit becomes extremely low and the suction valve is fully closed under these conditions. Further control ordinarily cannot be exercised over the unit and the supply air temperature will drift uncontrollably until such time that control is regained.

The previously noted trim heater 30 positioned in the supply air flow passage is adapted to be turned on by the processor. The trim heater is engaged when the controller, which monitors the valve position, signals that the suction valve is approaching a fully closed position and that, judging from recent accumulated supply air temperature deviations, the refrigeration control system is approaching uncontrollable conditions. The heater adds sufficient heat to the supply air flow moving over the evaporator so that the unit will remain operating above minimum capacity. The heater is programmed to remain on until such time as the suction valve position is greater than 40% of the full open position at which time it is turned off.

While this invention has been explained with reference to the structure disclosed herein, it is not confined to the details set forth and this application is intended to cover any modifications and changes as may come within the scope of the following claims.

What is claimed is:

1. A method of controlling the temperature inside a mobile cargo container that is equipped with a refrigeration unit for supplying chilled air to the container, the method including:

providing an adjustable control valve in a suction line leading to the refrigeration unit compressor, said valve being adjustable in uniform increments between a fully opened and a fully closed position, periodically sensing the temperature of the supply air being discharged from the refrigeration unit into the container at given intervals, comparing the sensed temperature to a predetermined set point temperature to determine the amount of deviation between the two temperatures, fully opening the control valve when the amount of deviation is greater than a first value whereby the supply air temperature is changed at a fast rate, adjusting the control valve a first number of increments during each sensing interval when the amount of deviation is between said first value and a second lesser value whereby the supply air temperature is changed at an intermediate rate, and adjusting the control valve a second lesser a number of increments during each sensing interval when the amount of deviation is less than said second value whereby the supply air temperature is changed at a relatively slow rate.

2. The method of claim 1 wherein said first temperature value is about 2.5° C. from the set point temperature and said second value is about 1.0° C. from the set point temperature.

3. The method of claim 1 wherein the second number of increments that the valve is adjusted during each sensing interval is sufficiently small to maintain the supply air temperature within ±0.25° C. of the set point temperature.

* * * * *